United States Patent [19]

Mc Murray

[11] 3,976,015

[45] Aug. 24, 1976

[54] FREE STANDING SHELF UNIT

[76] Inventor: Paul L. Mc Murray, 7495 Salinas Trail, Youngstown, Ohio 44512

[22] Filed: June 4, 1975

[21] Appl. No.: 583,848

[52] U.S. Cl. ..... 108/92; 108/48

[51] Int. Cl.[2] ..... A47B 57/00

[58] Field of Search ..... 108/108, 110, 92, 48, 108/42, 106, 161; 182/230; 211/90, 83, 134, 133; D6/181, 186

[56] References Cited

UNITED STATES PATENTS

| | | | |
|---|---|---|---|
| 2,649,972 | 8/1953 | Weil | 108/108 X |
| 2,812,220 | 11/1957 | King | 182/230 |
| 2,956,688 | 10/1960 | Galassi | 108/108 |
| 3,213,965 | 10/1965 | Fedoryk | 182/230 |
| D106,184 | 9/1937 | Erickson | D6/186 |

*Primary Examiner*—James T. McCall

*Attorney, Agent, or Firm*—Webster B. Harpman

[57] ABSTRACT

A free standing shelf unit including at least a pair of vertical supports adapted to support a plurality of vertically spaced shelves extending outwardly therefrom, each of said plurality of shelves being of progressively narrower width with respect to the shelf therebelow and positioned on said vertical supports by brackets angularly disposed with respect to both the width and length dimensions of the shelves.

4 Claims, 4 Drawing Figures

FREE STANDING SHELF UNIT

BACKGROUND OF THE INVENTION

1. Field of the Invention

This invention relates to shelf structures which may be used for holding various articles including books or the like.

2. Description of the Prior Art

Prior structures of this type usually employ vertical supports on the front and back corners of a plurality of shelves such as conventional shelving and bookcases. Alternate prior art constructions include vertical supports attached to walls or the like and holding a plurality of shelves extending therefrom and depending on the wall support for maintaining the desired vertical arrangement of the shelves.

Still others position vertical supports at the ends of a plurality of vertically spaced shelves and include bases for maintaining the assembly in upright position.

U.S. Pat. No. 2,999,743 provides hooks on the upper ends of the vertical supports which are engageable with brackets attached to a wall and U.S. Pat. No. 3,042,220 provides vertical supports and a plurality of shelves and forwardly extending adjustable legs to hold the shelves against a wall.

This invention provides a simpler, more practical free standing shelf unit which is dimensioned so that upon being positioned adjacent a wall surface it leans thereagainst without being attached thereto.

SUMMARY OF THE INVENTION

A free standing shelf unit comprises at least a pair of vertical supports horizontally spaced and having a plurality of shelves supported thereon and extending outwardly therefrom, each of the shelves is of progressively narrower width from the bottom to the top of the shelf unit so that the unit will lean against a wall and always have the lower ends of the vertical supports positioned further from the wall than the upper ends. The shelves are attached to the vertical supports by brackets which are positioned at angles other than right angles with respect to the width and length dimensions of the shelves so as to prevent the shelves and the vertical supports from moving in a sidewardly bending or racking action.

DESCRIPTION OF THE PREFERRED EMBODIMENT

Figure 1:
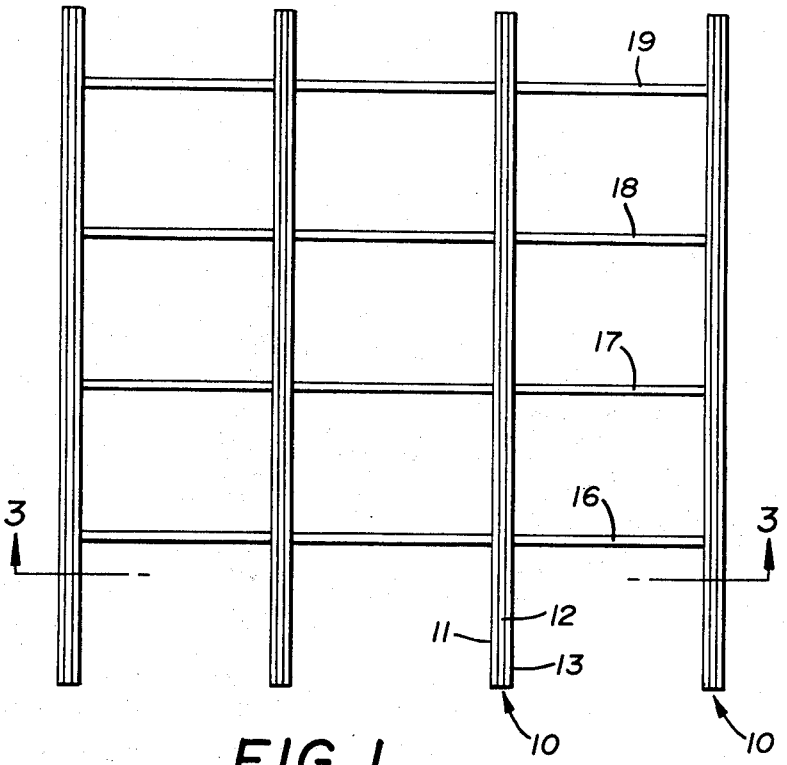
FIG. 1 is a front plan view of the free standing shelf unit.
Figure 2:
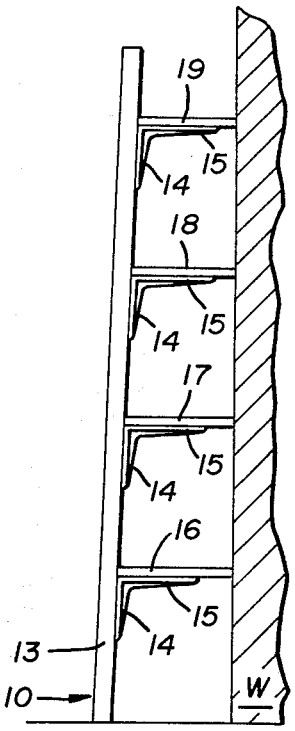
FIG. 2 is a side view thereof showing the same positioned against a wall.

In the form of the invention chosen for illustration herein as best seen in FIGS. 1 and 2 of the drawings, the free standing shelf unit comprises a plurality of vertical supports 10 horizontally spaced and standing at a slight angle from vertical as best seen in FIG. 2 of the drawings. These vertical supports may be formed of any suitable material although wood is preferred and as illustrated comprise built up assemblies of three strips 11, 12 and 13 the middle strip 12 being of lesser depth than the outer two to create an attractive appearance.

Those skilled in the art will observe that the strips may be covered with printed wood grained vinyl sheet material and if desired a cellular polyvinyl chloride decorative strip may be added in the vertical center section of each of the vertical supports 10.

A plurality of vertically spaced brackets 14 are attached to the back sides of each of the vertical supports 10 as best seen in FIG. 2 of the drawings and by referring thereto it will be seen that each of these brackets 14 has a vertical section attached to the vertical supports 10 and a horizontal portion extending outwardly therefrom, rearwardly as seen in FIG. 2 of the drawings.

A portion of a wall W is also seen in FIG. 2 of the drawings and it will be observed that the rear edges of the shelves 16 through 19 are directly engaged on the vertical surface of the wall W and it will further be seen that each of the shelves 16 through 19 are progressively narrower from the bottom to the top so that the vertical supports 10 stand at an angle from vertical as seen in FIG. 2 of the drawings, causing the shelf unit to lean against the wall W.

By way of example a typical free standing shelf unit formed in accordance with this invention has an overall width of 6 feet as seen in FIG. 1 of the drawings with the vertical supports 10 positioned on 2 foot centers and the shelves 16 through 19 spaced vertically 16 inches on centers with the lower shelf 16 being preferably spaced 16 inches above the lower ends of the vertical supports 10.

In this typical example the lowermost shelf 16 has a width of 11⅞ inches, the shelf 17 has a width of 11¾ inches, the shelf 18 has a width of 11⅝ inches, and the top shelf 19 has a width of 11½ inches, the top shelf 19 therefore being ⅜ of an inch narrower than the bottom shelf 16 and the vertical supports 10 each being ⅜ of an inch from vertical.

Those skilled in the art will observe that the inclination of the vertical supports is such that it does not visually detract from the appearance of the free standing shelf unit and is sufficient to cause the unit to lean against the wall W and be self supporting.

Figure 3:
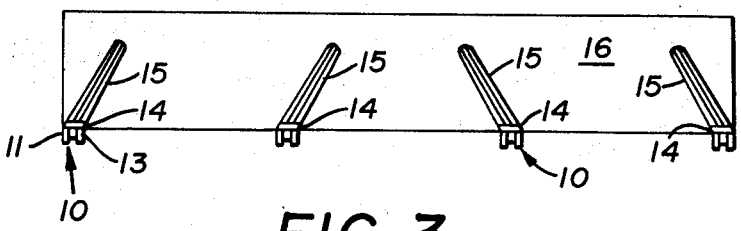
FIG. 3 is a bottom elevation on line 3—3 of FIG. 1.

By referring now to FIG. 3 of the drawings it will be seen that each of the horizontal portions 15 of the brackets 14 is disposed at an angle other than a right angle with respect to its plane of attachment to the vertical supports 10 and with respect to the longitudinal edges of the shelf 16, each of the brackets 14 supporting each of other shelves is similarly formed and positioned.

Still referring to FIG. 3 of the drawings it will be seen that the pair of brackets 14 in the left half of FIG. 3 are disposed at angles inwardly from the left end of the shelf 16 and the pair of brackets 14 in the right half of FIG. 3 are disposed at angles inwardly of the right end of the shelf 16 and the same is true of each of the several brackets 14 and their horizontal portions 15 that support the other shelves in the free standing shelf unit of the invention. The angular disposition of the horizontal portions 15 of the brackets 14 prevents sideward or longitudinal movement of the shelves 16 through 19 relative to the vertical supports 10 and thereby eliminates racking or swaying and forms a rigid unit.

Figure 4:
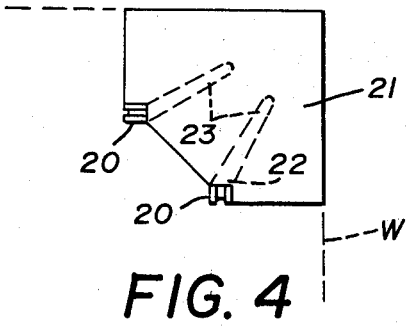
FIG. 4 is a top plan view of a modified free standing shelf unit for a corner location.

It will occur to those skilled in the art that the principal of construction disclosed herein can be applied to a corner shelf assembly or a bookcase and a top plan view of such a modification is shown in FIG. 4 of the drawings.

By referring to FIG. 4 of the drawings it will be seen that a pair of vertical supports 20 are positioned in horizontally spaced relation and on the cut off corner of an otherwise square shelf 21. A plurality of such shelves are included in the corner shelf unit. A plurality of brackets 22, each of which has an angular horizontal portion 23 are attached to the vertical supports 20 and are angularly disposed with respect to the longitudinal edges of the shelves 21. The corner shelf unit seen in FIG. 4 of the drawings will stand in the corner of a room and lean against the two walls forming the corner and the vertical arrangement of the shelves in the corner unit are like those of the shelf unit heretofore described in FIGS. 1, 2 and 3 of the drawings in that each of the shelves is progressively narrower from the bottom to the top of the unit with respect to both the wall surfaces of the corner in which the unit is positioned so that it inclines toward the corner which is the upper right hand corner of the shelf 21 as seen in FIG. 4 of the drawings.

The above described structure provides a practical, efficient, good looking and inexpensive shelf unit which provides relatively easy and fast assembly and which functions efficiently in use.

Although but two embodiments of the present invention have been illustrated and described it will be apparent to those skilled in the art that various changes and modifications may be made therein without departing from the spirit of the invention and having thus described my invention, what I claim is:

1. A free standing shelf unit adapted to lean on a wall and comprising at least a pair of vertical supports, each of which has a front side and a back side, a plurality of horizontally disposed shelves and means on the back sides of said vertical supports holding and positioning said shelves in vertically spaced relation and outwardly therefrom, each of said shelves being of uniform length and progressively narrower in width than the others with the narrowest of said shelves being positioned in uppermost position and the widest of said shelves being positioned in lowermost position, whereby said vertical supports stand at an angle from vertical when the edges of the shelves opposite to the vertical supports are engaged against said wall.

2. The shelf unit set forth in claim 1 and wherein said means on said vertical supports positioning said shelves comprises brackets affixed to said vertical supports and extending outwardly therefrom.

3. The shelf unit set forth in claim 1 and wherein said means on said vertical supports positioning said shelves comprises a plurality of brackets, each of which has a vertical portion attached to a vertical support and a horizontal portion extending outwardly therefrom and wherein the horizontal portion of each of said brackets is disposed on an angle other than a right angle relative to the longitudinal edge of the shelf positioned thereon.

4. The shelf unit set forth in claim 1 and wherein said vertical supports have a flat surface on the sides thereof adjacent the longitudinal edges of said shelves and wherein said means on said vertical supports positioning said shelves comprise brackets, each of which has a vertical portion having a flat surface secured to said flat surface of said vertical supports and a horizontal portion extending outwardly therefrom and disposed at an angle other than a right angle with respect to said flat surfaces.

* * * * *